US012392584B2

(12) United States Patent
Dabrowka

(10) Patent No.: US 12,392,584 B2
(45) Date of Patent: Aug. 19, 2025

(54) HEAT DISPERSION SYSTEM FOR BALLISTIC CARRIER

(71) Applicant: Jakub Dabrowka, Irvine, CA (US)

(72) Inventor: Jakub Dabrowka, Irvine, CA (US)

( * ) Notice: Subject to any disclaimer, the term of this patent is extended or adjusted under 35 U.S.C. 154(b) by 15 days.

(21) Appl. No.: 18/590,919

(22) Filed: Feb. 28, 2024

(65) Prior Publication Data

US 2024/0337468 A1 Oct. 10, 2024

Related U.S. Application Data

(60) Provisional application No. 63/458,434, filed on Apr. 10, 2023.

(51) Int. Cl.
*A41D 13/005* (2006.01)
*F41H 1/02* (2006.01)

(52) U.S. Cl.
CPC ..... *F41H 1/02* (2013.01)

(58) Field of Classification Search
CPC ..... F41H 1/02; A41D 13/0053
See application file for complete search history.

(56) References Cited

U.S. PATENT DOCUMENTS 6,490,733 B1 * 12/2002 Casaubon ..... A41D 13/0007 2/81
8,904,562 B2 * 12/2014 Aquino ..... F41H 1/02 2/2.5
9,511,915 B1 * 12/2016 Zigah ..... B65D 1/38
9,835,414 B2 * 12/2017 Blauer ..... A41D 27/02
10,584,942 B2 * 3/2020 Wellman ..... F41H 5/013
11,026,501 B1 * 6/2021 Dabrowka ..... F41H 1/02
11,079,203 B2 * 8/2021 Becker ..... A41D 13/0012
D979,848 S * 2/2023 Thompson ..... D29/101.4
D979,849 S * 2/2023 Thompson ..... D29/101.4
12,085,369 B2 * 9/2024 Miller ..... A41D 1/04
2008/0077210 A1 * 3/2008 Horn ..... A61F 7/10 607/108
2009/0014490 A1 * 1/2009 Bradley ..... A45F 3/04 224/576
2016/0116255 A1 * 4/2016 Billotte ..... F41H 1/02 2/2.5
2017/0082404 A1 * 3/2017 Blauer ..... F41H 1/02
2019/0029877 A1 * 1/2019 Betkowski ..... A41D 27/205
2019/0200572 A1 * 7/2019 Criswell ..... A01K 13/006
2019/0265005 A1 * 8/2019 Wellman ..... A41D 13/0153
2020/0041147 A1 * 2/2020 Goldie ..... A45C 15/00
2020/0355469 A1 * 11/2020 Becker ..... F41H 5/013
2021/0196029 A1 * 7/2021 Dabrowka ..... F41H 1/02
(Continued)

*Primary Examiner* — Robert H Muromoto, Jr.
(74) *Attorney, Agent, or Firm* — Vista IP Law Group LLP

(57) ABSTRACT

A ballistic armor carrier having a heat dispersion system for migrating heat away from between the ballistic carrier and a wearer's body. The ballistic carrier includes a carrier having a pocket for holding a ballistic panel and a thermal panel having a high thermal conductivity disposed within the pocket. The thermal panel wraps around the pocket such that the thermal panel has a first thermal panel portion configured to be positioned to the inside of the ballistic panel and a second thermal panel portion configured to be positioned to the outside of the ballistic panel. The thermal panel migrates heat away from the wearer's body from between carrier and the body to the outside of the carrier and dissipates the heat to the ambient environment.

20 Claims, 7 Drawing Sheets

(56) References Cited

U.S. PATENT DOCUMENTS

| | | | | |
|---|---|---|---|---|
| 2022/0390210 | A1* | 12/2022 | Thompson | F41H 1/02 |
| 2023/0204327 | A1* | 6/2023 | Lamb | F41H 1/02 2/2.5 |

* cited by examiner

HEAT DISPERSION SYSTEM FOR BALLISTIC CARRIER

RELATED APPLICATIONS

The present application claims the benefit of priority of U.S. provisional patent application No. 63/458,434, filed Apr. 10, 2023, which is incorporated by reference herein in its entirety.

BACKGROUND

The field of the present disclosure relates generally to body armor and ballistic carriers, and more specifically to a heat dispersion system for use with ballistic carriers for carrying ballistic panels and/or plates and ballistic carriers having the heat dispersion system integrated therein.

Ballistic carriers are tactical protective garments designed to carry ballistic panels such that the ballistic carrier and panels protect a wearer from bodily injury from attacks and other hazards. One of the most common ballistic carriers is a vest, commonly referred to as a "bullet proof vest." The ballistic carriers typically have pockets for inserting body armor to protect the wearer from ballistics, such as bullets and explosive fragments. There are two main types of body armor: hard-plate body armor (often referred to as "armored plates") which can protect a wearer from very high energy ballistics such as rifle rounds; and soft (non-plated) body armor (often referred to as "armored panels") which can protect a wearer from handgun rounds and small explosive fragments.

In view of their functions as protective gear and to ensure durability, ballistic carriers are made of heavy duty, strong materials capable of supporting the body armor and surviving harsh conditions and rigorous duty cycles. As a result, the weight, profile and materials used of ballistic carriers and body armor carried therein, these tactical garments are high thermal insulators which trap body heat. Combined with the environments and physical activity often associated with their use, the person wearing such tactical armor often experiences excess heat, sweat, and associated discomfort, or even heat exhaustion and dehydration.

Some devices for alleviating the heat and perspiration caused by wearing ballistic carriers have been previously disclosed. For example, air circulation devices that blow a pressurized volume of air using electric fans through the ballistic carrier have been described. However, such devices are bulky and inefficient, and require a source of electric power. Passive garments worn under the ballistic carrier have also been disclosed, but such garments are relatively ineffective, and provide at most a small amount of relief from perspiration via wicking wetness from the wearer's skin and no cooling effect. Accordingly, there is a need for an improved design for providing cooling effects for tactical garments such as ballistic carriers like bullet proof vests and other tactical and protective garments.

SUMMARY OF THE DISCLOSURE

Disclosed herein is a ballistic carrier for carrying ballistic armor and having a heat dispersion system which utilizes an innovative multi-layer thermal panel having a high thermal conductivity to transfer heat away from between the ballistic carrier and the wearer's body to the exterior side of the ballistic armor. The ballistic carrier may be worn and used with, or without, ballistic panels inserted into the carrier.

Accordingly, in one disclosed embodiment, a ballistic carrier comprises a carrier configured to be worn on a body of a person or other animal, such as a dog, horse, especially animals used in law enforcement and. The carrier has a first body panel for covering a part of a wearer's body. As used herein, the term "wearer" refers to any animal, such as a person, or other animal such as a dog, horse, etc. For example, the first body panel may be a front portion configured to cover a front of the wearer, such as the front portion of a ballistic vest. The first body panel has an inner panel configured to rest against the body and an outer panel opposing the inner panel and being external to the inner panel. The inner panel and outer panel are configured to form a pocket or housing for holding a ballistic panel. For example, the ballistic panel may be body armor such as an armored plate or armored panel. The inner panel has an inside surface which faces the body of the wearer and an outside surface which faces away from the body and forms an inner side of the pocket. The outer panel has an outside surface which faces away from the body, and an inside surface which faces toward the body and forms an outer side of the pocket opposing the inner side of the pocket. The pocket has an opening for inserting the ballistic panel and a closure for closing the opening. For instance, the closure may be a length of mating hook and loop fasteners, snaps, buttons, or the like. In another aspect, the opening is on a lateral side of the ballistic carrier (i.e., not on the bottom or top of the carrier) such that a ballistic panel is inserted into the pocket from the side.

A thermal panel is attached to the first body panel within the pocket. The thermal panel comprises a first layer of heat absorbing textile comprising phase change molecules (PCMs), and a second layer applied to, and covering, the first layer. The second layer comprises a heat transfer film comprising oriented graphite with a high thermal conductivity. The thermal panel has a first thermal panel portion attached to the outside surface of the inner panel with the heat absorbing textile side of the thermal panel against the outside surface of the inner panel. The first thermal panel portion is positioned such that it is on an inside of a ballistic panel inserted into the pocket. The first thermal panel portion covers a substantial part of the outside surface of the inner panel. As used herein, the term "substantial part" means at least 75% or more.

The thermal panel also bends around proximate to an edge of the pocket and has a second thermal panel portion which extends along a portion of the inside surface of the outer panel such that the second thermal panel portion is on an outside of a ballistic panel inserted into the pocket. In one aspect, the second thermal panel portion extends along at least 10%, or at least 20%, or at least 25%, or at least 30%, or at least 40%, or at least 50% of the full length of the pocket or of the inside surface of the outer panel, or of the full length of a ballistic panel to be inserted into the pocket. In this way, the thermal panel absorbs heat expelled by the body, dissipates the heat, and transports the heat from the first thermal panel portion close to the body to the second thermal panel portion positioned proximate the outer panel of the pocket, i.e., on an outside of a ballistic panel inserted into the pocket.

Accordingly, the ballistic carrier, when worn on a body, provides a cooling effect and relief from building up body heat within the carrier by transferring heat away from the interior of the ballistic carrier and dissipating the heat on the outside on the outside of the carrier and into the ambient environment.

In another aspect, the thermal panel may further include a backing layer applied to, and covering, the other side of the heat transfer film opposite the heat absorbing textile. The backing layer may comprise a fabric which provides a good surface for bonding the thermal panel to other materials.

In still another aspect, the inner panel may comprise a mesh fabric. In yet another aspect, the inner panel may further comprise a heat spreading layer disposed on an inside surface of the mesh fabric facing the body side of the carrier. The heat spreading layer comprises a fabric having a mesh of PCMs applied onto the fabric to absorb heat from expelled from the body and spread the heat over the area of the fabric. The heat dissipated over the heat spreading layer then migrates to the thermal panel, and is transported through the thermal panel as described above. Alternatively, the inner panel may comprise the heat spreading layer without a mesh fabric.

In yet another aspect, the outer panel may comprise a mesh fabric. The mesh fabric may be the same or similar to the mesh fabric of the inner panel. For example, the mesh fabric forming the outer panel may form at least a portion of the outer-most surface of the ballistic carrier. In yet another aspect, the outer panel may further comprise a heat spreading layer disposed on an inside surface of the mesh fabric facing the body side of the carrier. The heat spreading layer may be the same or similar material as the heat spreading layer on the inner panel. In other aspects, additional materials, layers and/or devices may be attached to an outer surface of the mesh fabric outer panel, such as hook and/or loop fasteners, "PALS" or "MOLLE" carrying systems, straps, etc.

In another aspect, the ballistic carrier is a torso worn garment, such as a vest, jacket, or the like, and the first body panel is a front portion of the garment configured to cover the front torso of the wearer. In yet another aspect, the ballistic carrier further comprises a second body panel which is a back portion of the garment configured to cover the back torso of the wearer. The second body panel is attached to the first body panel by a pair of shoulder straps. The carrier may also have side straps for attaching a lower portion of the first body panel to a lower portion of the second body panel. The side straps may be detachably fastenable using hook and loop fasteners, snaps, buttons, etc.

In still another aspect, the second body panel may also be configured to carry a back ballistic panel and also to have the heat dispersion system like the first body panel. The heat dispersion system for the second body panel may be the same or different from the first body panel, and may include any one or more of the aspects and features of the heat dispersion system described herein.

The opening for inserting the front ballistic panel may be on the side of the first body panel ballistic carrier and is oriented vertically with the opening. Similarly, the opening for inserting the back ballistic panel is on the side of the first body panel ballistic carrier and is oriented vertically with the opening. In another aspect, the opening for inserting the front ballistic panel may be on the bottom side of the first body panel ballistic carrier such that the panel is inserted by sliding the panel upward into the respective pocket of the carrier. Similarly, the opening for inserting the back ballistic panel may be on the bottom side of the first body panel ballistic carrier such that the panel is inserted by sliding the panel upward into the respective pocket of the carrier.

In still another aspect, the ballistic carrier may include a front ballistic panel inserted into the pocket of the first body panel, and/or a back ballistic panel inserted into the second body panel, if one. The ballistic panel(s) may be any suitable ballistic panel, such as an armored plate, an armored panel, or the like.

In still another aspect, the ballistic carrier may further include an undergarment configured to be worn by a wearer such that an outer surface of the undergarment contacts the interior section of the first body panel and/or the interior section of the second body panel. The undergarment may comprise phase change material molecules to absorb and spread body heat. For example, the undergarment may function as the heat spreading layer described above. In such case, the outer surface of the undergarment contacts the inside surface of the interior section, which may be an interior mesh layer of the carrier.

BRIEF DESCRIPTION OF THE DRAWINGS

The drawings illustrate the design and utility of various aspects of the disclosure, in which similar elements are referred to by common reference numerals. These drawings are not necessarily drawn to scale. In order to better appreciate how the above-recited and other advantages and objects are obtained, a more particular description of the disclosure will be rendered, which is illustrated in the accompanying drawings. These drawings depict only exemplary aspects of the disclosure for purposes of illustration and facilitating the below detailed description, and are not therefore to be considered limiting of its scope.

DETAILED DESCRIPTION OF THE DISCLOSURE

Figure 1:
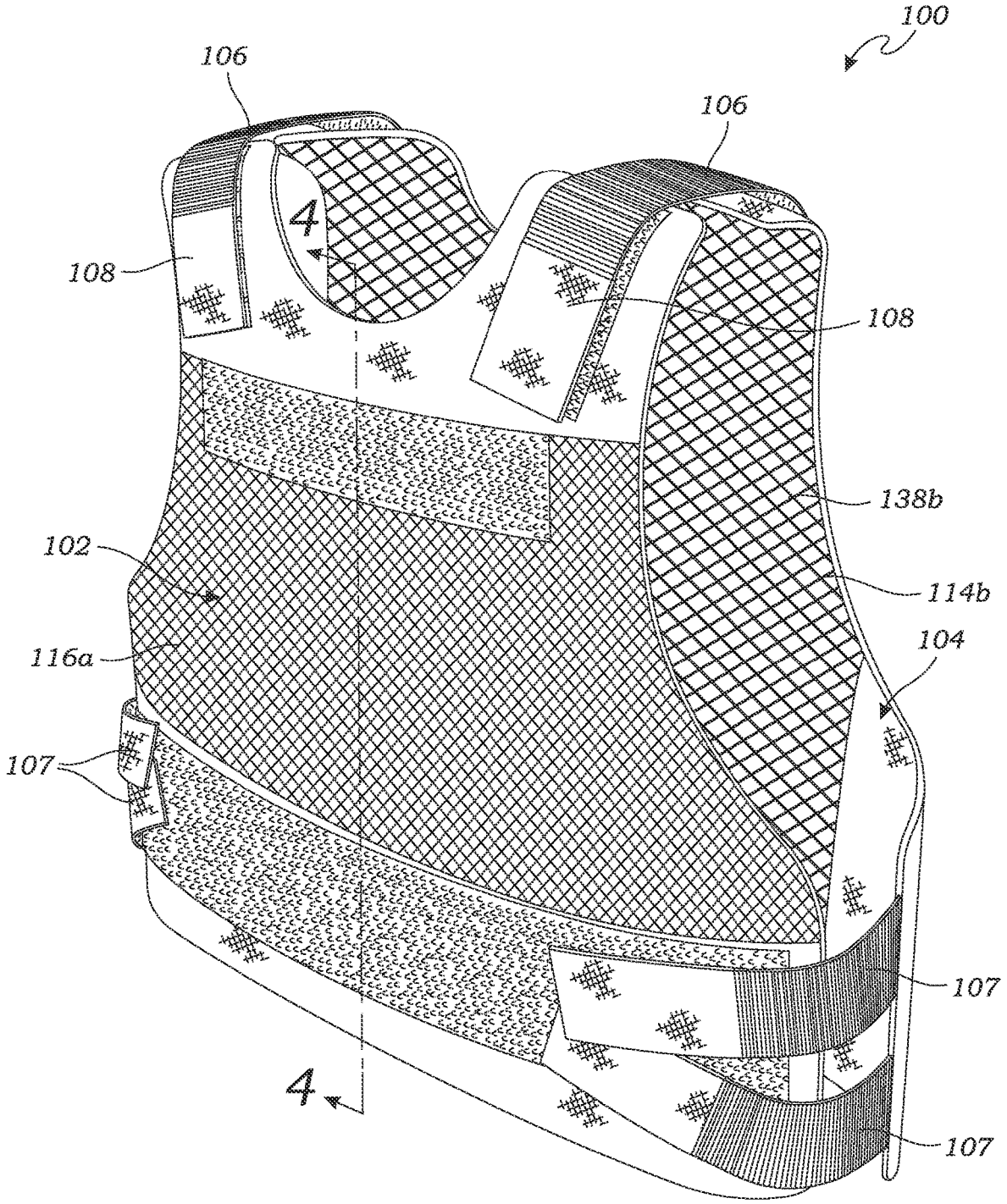
FIG. 1 is a front perspective view of a carrier in accordance with one example disclosed herein.

This specification describes exemplary embodiments, aspects and applications of the disclosure. The disclosure, however, is not limited to these exemplary embodiments, aspects and applications or to the manner in which the exemplary embodiments, aspects and applications operate or are described herein. Further, the figures may show simplified or partial views, and the dimensions of elements in the figures may be exaggerated or otherwise not in proportion. Moreover, elements of similar structures or functions are represented by like reference numerals throughout the figures. In addition, an illustrated aspect need not have all the features or advantages shown. A feature or an advantage described in conjunction with a particular aspect is not necessarily limited to that aspect, and can be practiced in any other aspect even if not so illustrated.

The present specification is directed to a ballistic carrier for carrying ballistic armor having a heat dispersion system. The heat dispersion system includes multi-layer thermal panel having a high thermal conductivity to conduct heat away from between the ballistic carrier and the wearer's body to the exterior side of the ballistic armor and away from the wearer into the ambient environment. Accordingly, the ballistic carrier delivers a cooling effect, preventing the build-up of body heat and sweat. It achieves this result by transferring heat away from between the wearer's body and the ballistic carrier and transmitting the heat to the outside, effectively releasing the heat into the surrounding environment.

Figure 2:
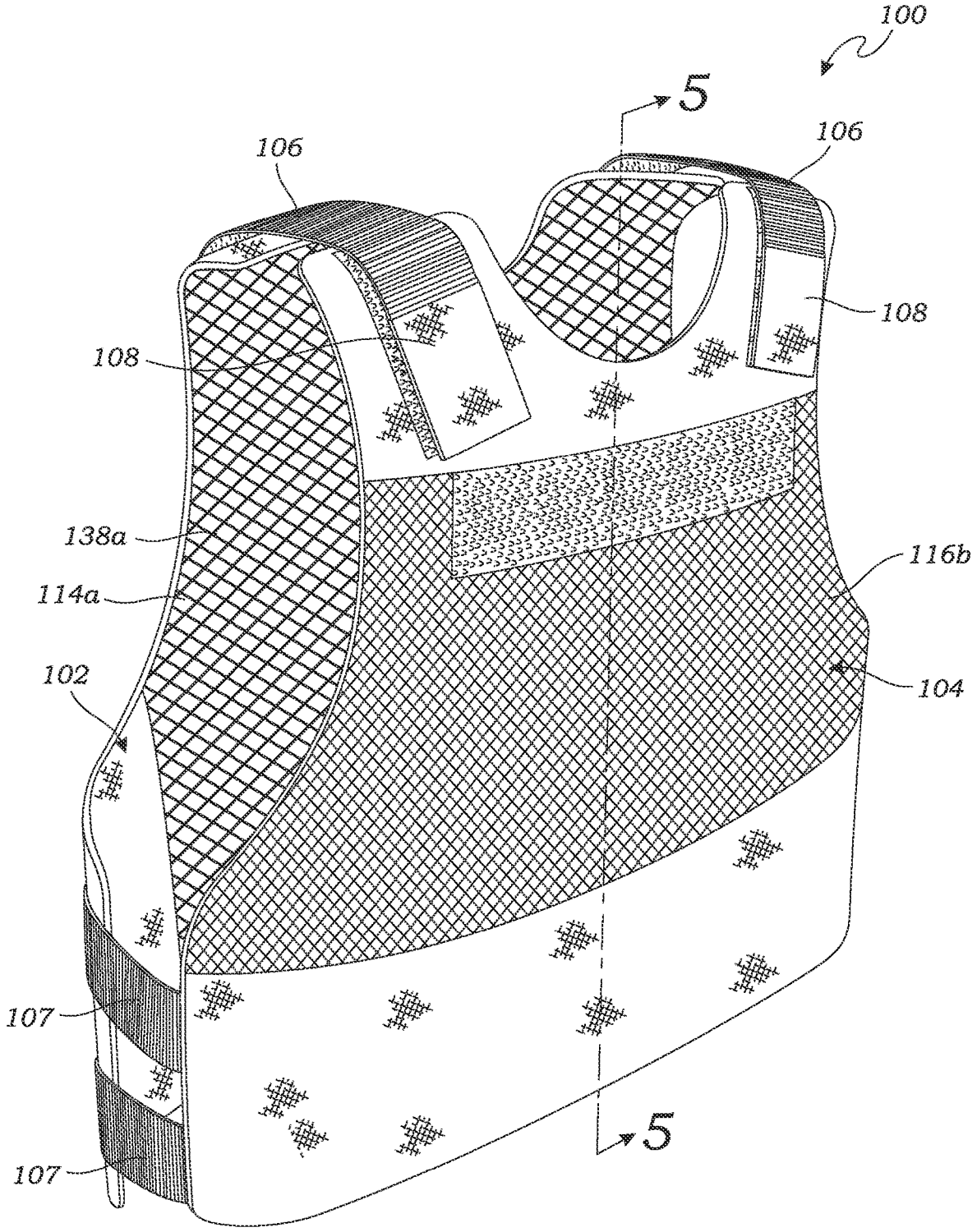
FIG. 2 is a rear perspective view of the carrier of FIG. 1.
Figure 3:
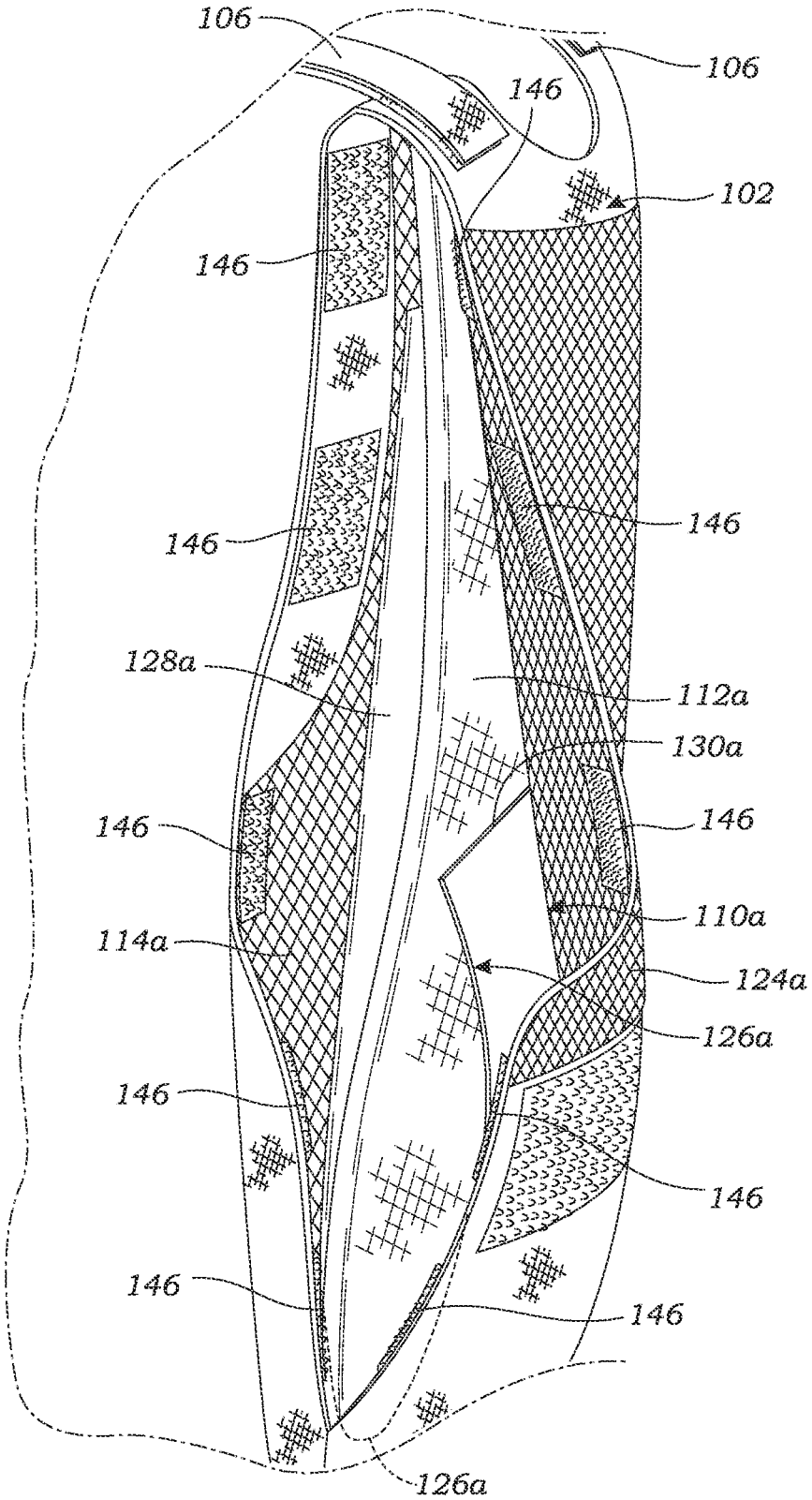
FIG. 3 is a side perspective view of the carrier of FIG. 1 with the side opening opened to view the internal components of the carrier.
Figure 4:
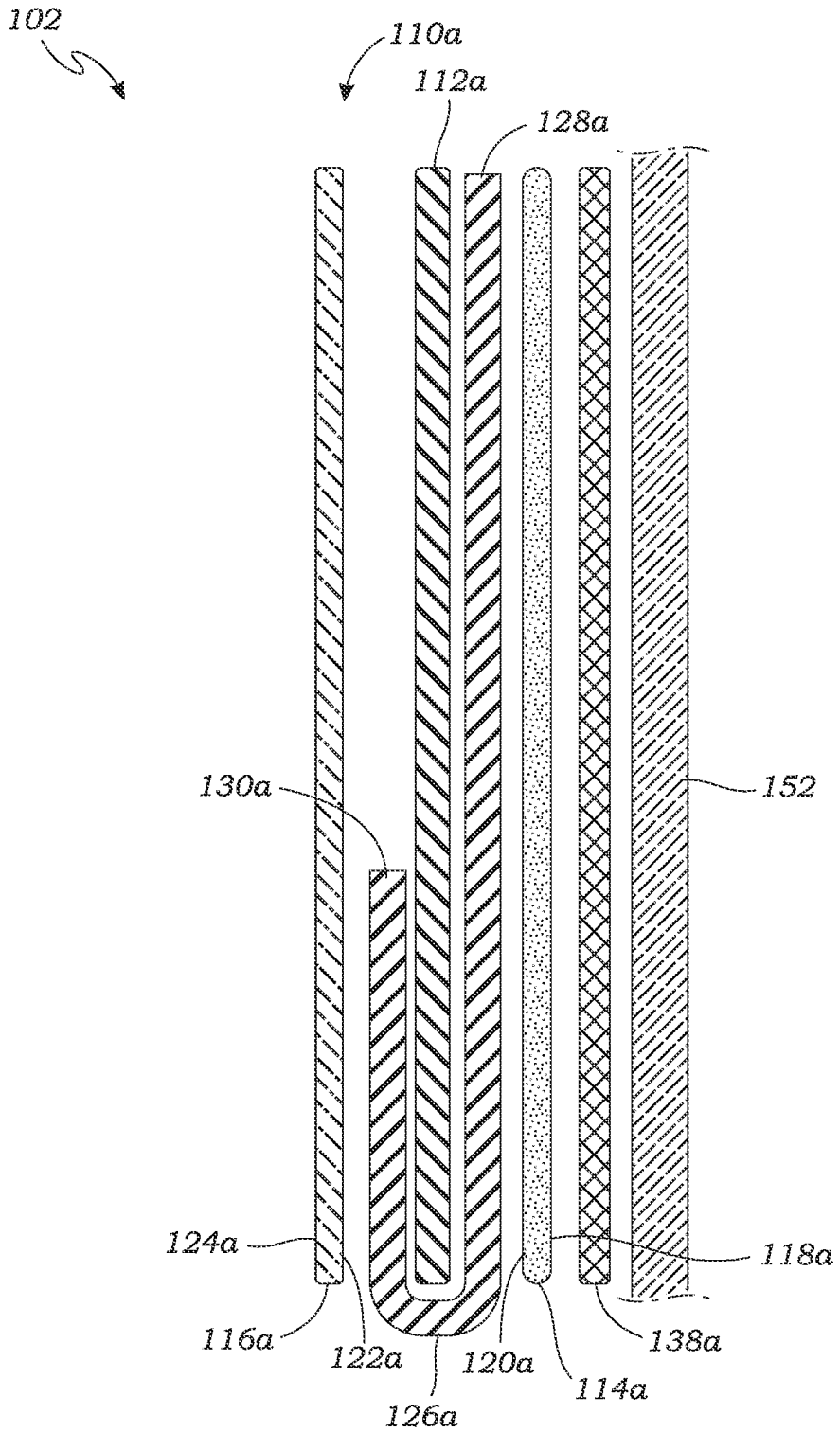
FIG. 4 is schematic cross-sectional view of the front panel of the carrier along line 4-4 of FIG. 1.
Figure 5:
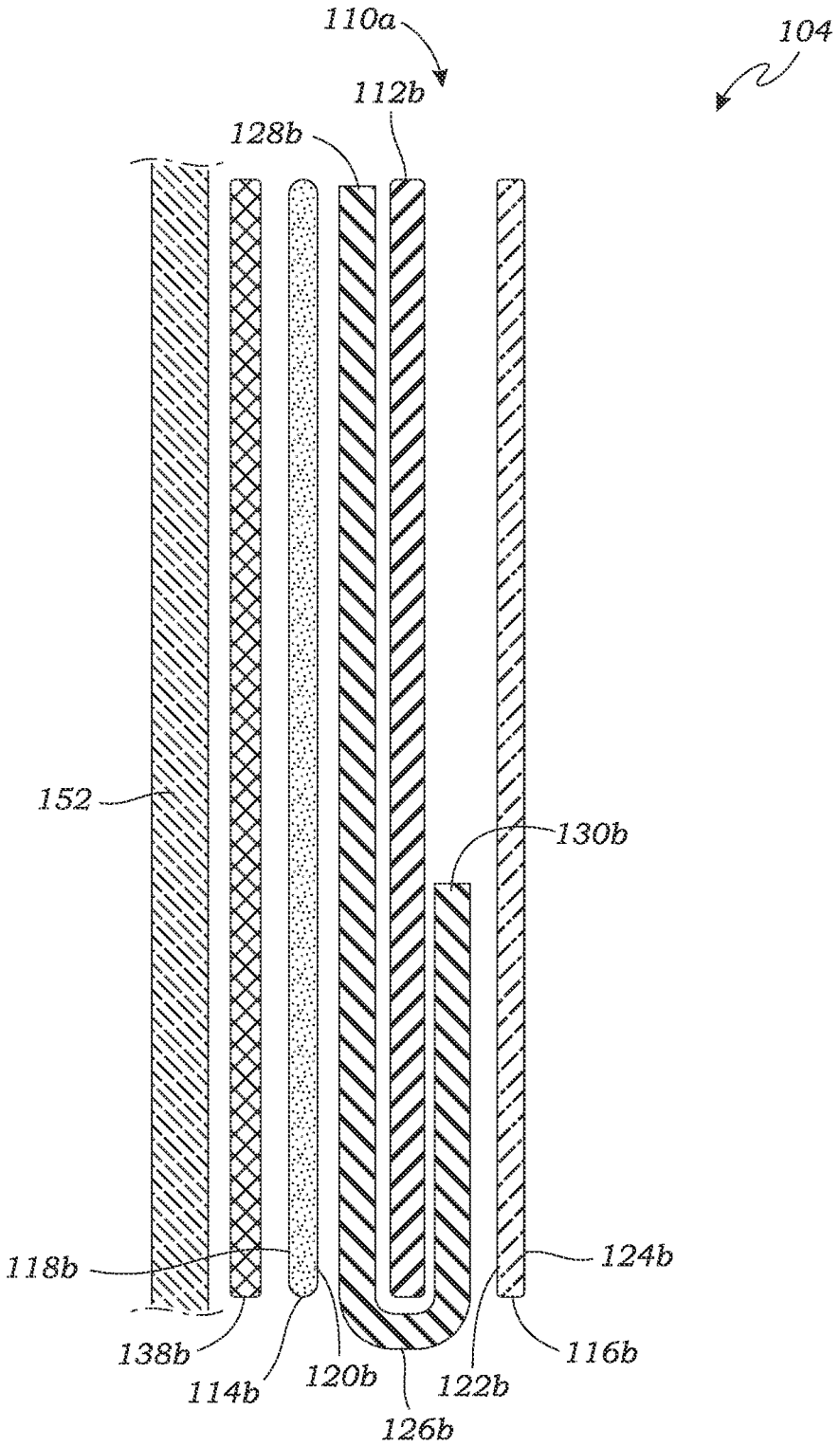
FIG. 5 is schematic cross-sectional view of the back panel of the carrier along line 5-5 of FIG. 1.

Referring now to FIGS. 1-7, one example of a ballistic carrier system 100 (also referred to as a ballistic carrier 100) for carrying ballistic armor and having a heat dispersion system for migrating heat away from a person 150 (i.e., the wearer) wearing the carrier 100 is illustrated. Although the drawings and the related description are directed to a ballistic carrier for a person, it is understood that present invention is not limited to ballistic carriers for a person but also include ballistic carriers for other animals such as a dog, horse, etc. As shown in FIGS. 1, 2 and 5, the example ballistic carrier 100 is in the form of a tactical armored vest (commonly referred to as a bullet-proof vest) having a front body panel 102 (also referred to as a "first body panel 102") and a back body panel 104 (also referred to as a "second body panel 104"). Although the example ballistic carrier 100 disclosed herein is an armored vest, it is understood that the ballistic carrier 100 may be any suitable garment or portion of a garment configured to be worn on a part of the body of a person to protect such part of the body. For example, the ballistic carrier may be a tactical jacket, a tactical shirt, tactical pants, a tactical belt, a tactical skirt, etc. For other animals, the ballistic carrier may be a K-9 vest for a dog, or an equine vest for a horse, etc.

As illustrated in FIG. 5, the ballistic carrier 100 is configured to be worn as a vest over the torso 154 of the body 152 of the person 150. The front body panel 102 is configured to cover the front torso of the person 150, and the back body panel 104 is configured to cover the back torso of the person 150. The front body panel 102 and back body panel 104 are releasably attached at the top of the respective panels 102, 104 by a pair of shoulder straps 106. The straps 106 may be releasably attached using respective fasteners 108, such as hook and loop fasteners, snaps, buttons, or the like. Alternatively, one side of the straps 106 may be permanently attached to one of the front body panel 102 or back body panel 104, such as sewn, bonded, etc., while the other side of the straps 106 is releasably attached to the other of the front body panel 102 or back body panel 104. The carrier 100 also has side straps 107 for attaching a lower portion of the front body panel 102 to a lower portion of the back body panel 104. The side straps 107 may be detachably fastenable using hook and loop fasteners, snaps, buttons, etc.

The front body panel comprises an inner panel 114*a* and an outer panel 116*a* which are attached to each other around their respective periphery edges such that a pocket 110*a* for holding a front ballistic panel 112*a* is formed between the inner panel 114*a* and the outer panel 116*a*, as best shown in FIGS. 3 and 4. The back body panel 104 has a similar pocket 110*b* for holding a back ballistic panel 112*b*, the pocket 110*a* is formed between an inner panel 114*a* and an outer panel 116*a*. The inner panel 114*a* and outer panel 116*a* may be formed of a mesh fabric or other suitable textile. The inner panel 114*a* has an inside surface 118*a* which faces the body 152 (more specifically, the front of the body 152) and an outside surface 120*a* which faces away from the body 152 and forms the inner side of the pocket 110*a*. The outer panel 116*a* has an inside surface 122*a* which faces toward the body of the person 150 and an outside surface 124*a* which faces away from the body 152.

The pocket 110*a* has an opening 144*a* for inserting the front ballistic panel 112*a* into the pocket 110*a*. The opening 144*a* is on the side edge of the front body panel 102 and is oriented vertically along the edge of the front body panel (the opening 144*a* can be on either side of the front body panel 102). The opening 144*a* is formed by a portion of the opposing side edges of the inner panel 114*a* and the outer panel 116*a* which are detachably fastened together by a closure 146*a*. The closure 146*a* comprises mating hook and loop fasteners extending along a length of the side edges of the inner panel 114 and outer panel 116*a*. The closure 146*a* may comprise any other suitable fasteners such as buttons, snaps, ties, clips, or the like.

A thermal panel 126*a* is attached to the first body panel 102 within the pocket 110*a* adjacent to, and on the outside of, the inner panel 114*a*. As one example, the thermal panel 126*a* may be attached to the inner panel 114*a* such as by being sewn, bonded, or otherwise suitably attached. The thermal panel 126*a* has a first thermal panel portion 128*a* which extends from proximate the top of the pocket 110*a* and inner panel 114*a*, downward to proximate the bottom edge of the pocket 110*a* and inner panel 114*a*, such that the first thermal panel portion 128*a* is configured to be positioned on the inside of the ballistic panel 112*a*. The first thermal panel portion 128*a* covers a substantial part (i.e., at least 75% or more) of the outside surface 120*a* of the inner panel 114*a*. Alternatively, the first thermal panel portion 128*a* may cover at least 70% or more, or 65% or more, or 55% or more of the outside surface 120*a* of the inner panel 114*a*.

The thermal panel 126*a* then bends around the bottom of the pocket 110*a* to towards the front of the pocket 110*a*, and then a second thermal panel portion 130*a* of the thermal panel 126*a*, extends upward along the inside surface 112*a* of the outer panel 116*a* such that the second thermal panel portion 130*a* is configured to be positioned on the outside of the ballistic panel 112*a*. There is a space between the first thermal panel portion 128*a* and the second thermal panel portion 130*a* for inserting the ballistic panel 112*a*. The second thermal panel portion 130*a* extends along a length of the inside surface 112*a* of the outer panel 116 and a length of the ballistic panel 126*a*. For example, the second thermal panel portion 130*a* extends along at least 10%, or at least 20%, or at least 25%, or at least 30%, or at least 40%, or at least 50%: of the full length of the inside surface 122*a* of the outer panel 116*a*; or of the full length of the pocket 110*a*; or of the full length of the ballistic panel 112*a*. The second thermal panel portion 130*a* expels heat absorbed by the first thermal panel portion 128*a* and conducted by and along the thermal panel to the second thermal panel portion 130*a*. In other words, the first thermal panel portion 128*a* absorbs heat expelled by the body, dissipates the heat, and conducts the heat from the first thermal panel portion 128*a* close to the body and to the inside of the ballistic panel 112*a* to the second thermal panel portion 130*a* adjacent the outer panel 116*a* and to the outside of the ballistic panel 112*a*. As a result, the thermal panel 126*a* effectively transfers body heat around the high thermal insulating ballistic panel 112*a* and expels the heat into the ambient environment. The transfer of body heat by the thermal panel 126*a* provides a cooling effect to the body 152 and prevents body heat from building up within the carrier 100 by conducting heat away for the interior of the ballistic carrier proximate the body, dissipating the heat to the outside of the carrier 100 and into surrounding air. The second thermal panel portion 130*a* may be unattached or loose such that the thermal panel 126*a* can be wrapped around the bottom end of the front ballistic panel 112*a*. Alternatively, the second thermal panel portion 130*a* can be attached to the outer panel 116*a* by being sewn, bonded, or otherwise suitably attached.

Figure 6:
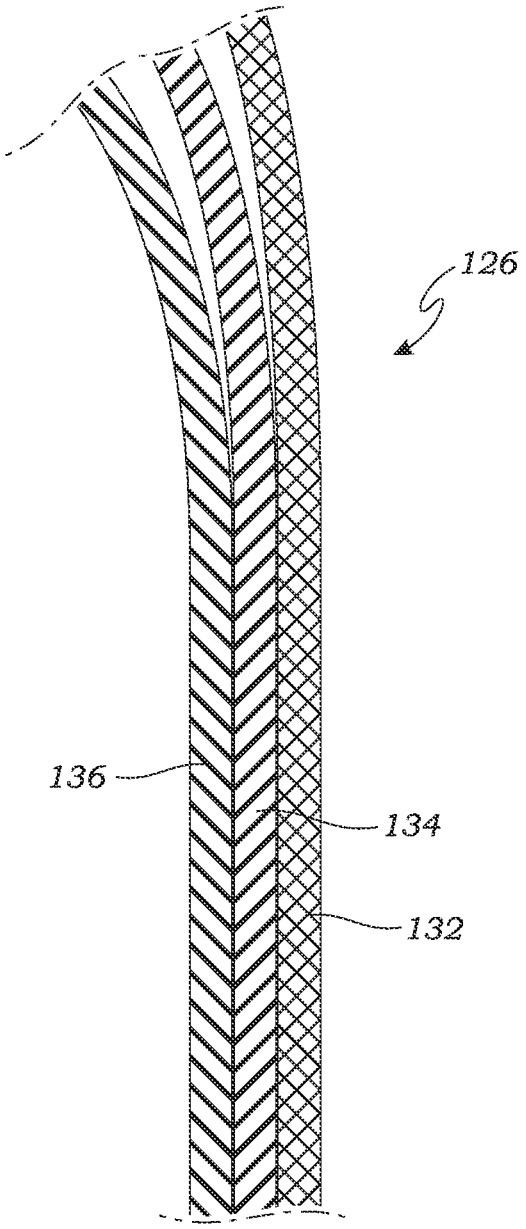
FIG. 6 is a schematic cross-sectional view of the thermal panel shown in FIGS. 4 and 5.

Referring to FIG. 6, the thermal panel 126*a* is a multi-layer panel having a high thermal conductivity for efficiently transferring heat. The thermal panel 126*a* includes a first layer 132 of heat absorbing textile (HAT) comprising phase change molecules (PCMs) (e.g., microencapsulated phase change materials (mPCMs)). The heat absorbing textile is configured to efficiently absorb heat energy at about 28° C. (82° F.) and dissipate and spread the heat over the area of the heat absorbing textile. The thermal panel also has a second layer 134 applied to, and covering the first layer 132. The second layer comprises a heat transfer film (HTF) comprising highly oriented graphite configured to efficiently and directionally conduct heat energy. The thermal panel 126*a* may also have a third layer 136 (also referred to as a "backing layer 136") comprising a backing fabric applied to, and covering, the other side of the second layer 134 opposite the first layer 132. The backing layer 136 is configured to protect the second layer 134 comprising the heat transfer film and to provide a suitable surface for bonding the thermal panel 126*a* to other materials, such as the inner panel 114*a*. As one non-limiting example, the thermal panel 126 may comprise ECLIPSYS™ thermal sheet material available from Alexium Inc., Greer, South Carolina.

Turning back to FIG. 4, the inner panel 114*a* may further comprise an inner heat spreading layer 138*a* disposed on the inside surface 118*a* of the inner panel 114*a* (e.g., on the inside surface of the mesh fabric forming part of the inner panel 114). The inner heat spreading layer 138*a* comprises a fabric 140 having a mesh 142 of PCMs applied onto the fabric 140 to absorb heat expelled from the body 152 and distribute the heat over the area heat spreading layer 138*a*. The inner heat spreading layer 138*a* may also comprise aluminum, or other material having high thermal conductivity, embedded in the mesh 142 or otherwise distributed over the inner heat spreading layer 138*a*. For example, inner heat spreading layer 138*a* may comprise the XELERATE™ material available from OUTLAST® GmbH in Germany which is a fabric having a mesh of PCMs and aluminum. The inner heat spreading layer 138*a* is attached to the mesh fabric or other textile forming the inner panel 114*a* by being sewn, bonded or otherwise fastened to the inner layer 138*a*.

Referring now to FIG. 5, the back body panel 104 is very similar in construction to the front body panel 102, and includes all of the same components and features of the front body panel 102 and arranged in the same manner, including an inner panel 114*b*, an outer panel 116*b*, a pocket 110*b*, an opening 144*b*, a closure 146*b*, a thermal panel 126*b*, a first thermal panel portion 128*b*, a second thermal panel portion 130*b*, and an inner heat spreading layer 138*b*, etc. Accordingly, all of the description regarding the front body panel 102 and its components applies to the description of the back body panel 104.

Figure 7:
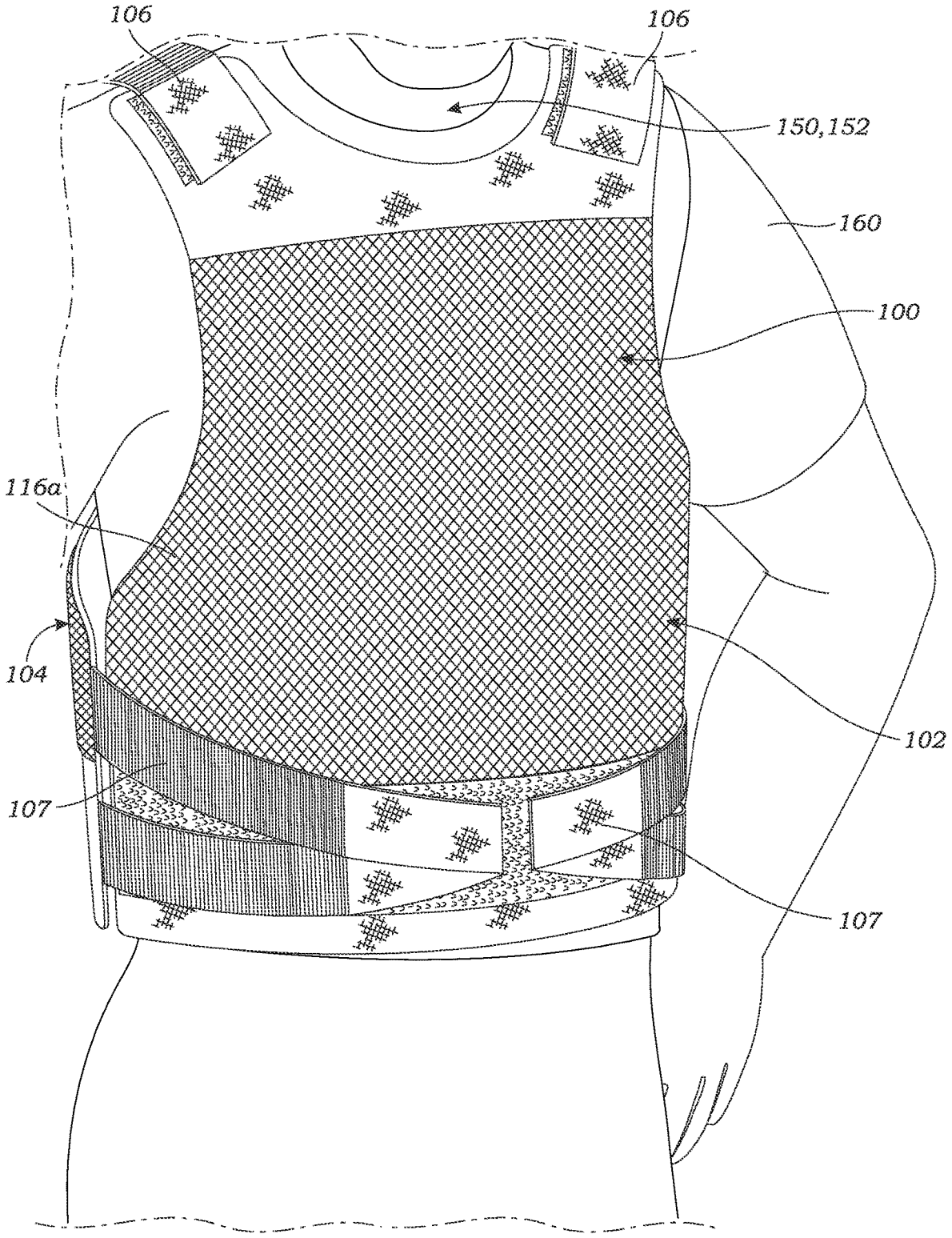
FIG. 7 is a front perspective view a person wearing the carrier of FIG. 1.

As illustrated in FIG. 7, the ballistic carrier system 100 may further comprise an undergarment 160 configured to be worn by the person 150 such that the outer surface of the undergarment contacts the inner panels 114*a*, 114*b* of the front body panel 102 and back body panel 104, respectively. The undergarment 160 may be shirt, for example a T-shirt, or other undergarment worn on the part of the body for which the ballistic carrier 100 is designed to be worn. The undergarment 160 may comprise PCMs same or similar to the inner heat spreading layers 138*a*, 138*b*, to absorb and dissipate the heat generated by the body 152.

The use and functionality of the ballistic carrier system 100 will now be described. Typically, the front and back ballistic panels 112*a*, 112*b* are first inserted into the front body panel 102 and rear body panel 104, respectively. For example, the front ballistic panel 112*a* is inserted into the pocket 110*a* through the opening 144*a* by unfastening the closure 146*a*, and sliding the front ballistic panel 112*a* into the pocket 110*a* such ballistic panel 112*a* is between the first and second thermal panel portions 128*a*, 130*a*, with the first thermal panel portion 128*a* directly to the inside of the front ballistic panel 112*a* and the second thermal panel portion 130*a* is directly to the outside of the front ballistic panel 112*a*. The closure 146*a* is then fastened to close the opening 144*a*. Similarly, the back ballistic panel 112*b* is inserted into the pocket 110*b* through the opening 144*b* by unfastening the closure 146*b*, and sliding the back ballistic panel 112*b* into the pocket 110*b* such that back ballistic panel 112*b* is between the first and second thermal panel portions 128*b*, 130*b*, with the first thermal panel portion 128*b* directly to the inside of the back ballistic panel 112*b* and the second thermal panel portion 130*b* is directly to the outside of the back ballistic panel 112*b*. The ballistic carrier 100 is now ready to be donned by the person 150.

The person 150 may first put on the undergarment 160 to provide additional thermal dissipation. Then, with the shoulder straps 106 attached to both the front body panel 102 and the back body panel 104, and the side straps 107 unfastened, the carrier 100 is put on over the person's head with such that the shoulder straps 106 are positioned on the shoulders of the person's body 152 with the front body panel 102 resting on and covering the front torso and the back body panel 102 resting on and covering the back torso. The side straps 107 are then fastened.

The heat dispersion system functions to absorb and transfer body heat away from the body 152. Heat expelled by the body is first absorbed and spread over the area by the undergarment 160, if worn by the person 150. For the front body panel 102, The heat is then absorbed by the inner heat spreading layer 138*a* and dispersed over the area of the inner heat spreading layer 138. The heat then migrates outward and is absorbed by the first thermal panel portion 128*a* of the thermal panel 126*a*. The thermal panel 126*a* disperses the heat in the thermal panel 126*a* and transfers the heat along the length of the thermal panel, around the front ballistic panel 112*a* to the second thermal penal portion 130*a* in front of the front ballistic panel 112*a*. The heat then transfers from the second thermal panel portion through the outer panel 116*a* (which may be a mesh fabric) and into the air in the surrounding environment. The dissipation of body heat by the back body panel 104 is the same. Accordingly, the ballistic carrier 100 provides a cooling effect and relief from building up body heat within the carrier 100 by transferring heat away from the interior of the ballistic carrier 100 and dissipating the heat on the outside on the outside of the carrier 100 and into the ambient environment.

Although particular embodiments have been shown and described, it is to be understood that the above description is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims. For example, not all of the components described in the embodiments are necessary, and the invention may include any suitable combinations of the described components, and the general shapes and relative sizes of the components of the invention may be modified. Accordingly, embodiments are intended to exemplify alternatives, modifications, and equivalents that may fall within the scope of the claims. The invention, therefore, should not be limited, except to the following claims, and their equivalents.

What is claimed is:

1. A ballistic carrier having a heat dispersion system, the ballistic carrier comprising:

a carrier configured to be worn on a body of a wearer, the carrier having a first body panel for covering a part of the body, the first body panel comprising:

an inner panel configured to lie against the body and an outer panel external and opposing the inner panel, the outer panel attached to the inner panel thereby forming a pocket between the inner panel and the outer panel for holding a ballistic panel, the inner panel having an inside surface facing the body and an outside surface facing away from the body, the outer panel having an inside surface facing the body and an outside surface facing away from the body;

a thermal panel attached to the first body panel within the pocket, the thermal panel having a first thermal panel portion attached to, and covering, at least a part of the outside surface of the inner panel and positioned such that it is to an inside of a ballistic panel when inserted into the pocket, the thermal panel bending around proximate an edge of the pocket to a second thermal panel portion, the second thermal panel portion extending along a portion of the inside surface of the outer panel such that the second thermal panel portion is to an outside of a ballistic panel when inserted into the pocket; and wherein the thermal panel is a multi-layer material having a high thermal conductivity.

2. The ballistic carrier of claim 1, wherein the thermal panel comprises a first layer of heat absorbing textile comprising phase change molecules (PCMs), and a second layer applied to, and covering, a first side of the first layer, the second layer comprising a heat transfer film comprising oriented graphite.

3. The ballistic carrier of claim 2, wherein the thermal panel further comprises a backing layer applied to, and covering, a second side of the heat transfer film opposite the first side.

4. The ballistic carrier of claim 1, wherein the first thermal panel portion covers at least 75% or more of the outside surface of the inner panel.

5. The ballistic carrier of claim 1, wherein the first thermal panel portion covers at least 55% or more of the outside surface of the inner panel.

6. The ballistic carrier of claim 1, wherein the second thermal panel portion extends along at least 25% of a full length of the pocket.

7. The ballistic carrier of claim 1, wherein the inner panel comprises a mesh fabric, and the outer panel comprises a mesh fabric.

8. The ballistic carrier of claim 7, wherein the inner panel further comprises an inner heat spreading layer attached to an inside surface of the mesh fabric, and the outer panel further comprises an outer heat spreading layer attached to an outside surface of the mesh fabric.

9. The ballistic carrier of claim 8, wherein the inner heat spreading layer and outer heat spreading layer each comprise a fabric having a mesh of phase change molecules (PCMs) and metallic material applied onto the fabric.

10. The ballistic carrier of claim 1, wherein the pocket has an opening has an opening for inserting the ballistic panel and a detachable closure for opening and closing the opening.

11. The ballistic carrier of claim 10, wherein the opening is on a side edge of the front body panel and is formed by a portion of opposing side edges of the inner panel and the outer panel which are detachably fastened together by the closure.

12. The ballistic carrier of claim 1, wherein the ballistic carrier is a torso worn garment selected from the group comprising: a vest and; a jacket.

13. The ballistic carrier of claim 1, further comprising a ballistic panel inserted into the pocket.

14. The ballistic carrier of claim 1, wherein the carrier is a vest, the first body panel is a front portion of the vest configured to cover the front torso of the wearer, and the carrier further comprises:

a second body panel which is a back portion of the vest and is configured to cover the back torso of the wearer, the second body panel attached to the first body panel by shoulder straps, the second body panel comprising:

an inner panel configured to lie against the body and an outer panel external and opposing the inner panel, the outer panel attached to the inner panel thereby forming a pocket between the inner panel and the outer panel for holding a ballistic panel, the inner panel having an inside surface facing the body and an outside surface facing away from the body, the outer panel having an inside surface facing the body and an outside surface facing away from the body;

a thermal panel attached to the first body panel within the pocket, the thermal panel having a first thermal panel portion attached to, and covering, at least a part of the outside surface of the inner panel and positioned such that it is to an inside of a ballistic panel when inserted into the pocket, the thermal panel bending around proximate an edge of the pocket to a second thermal panel portion, the second thermal panel portion extending along a portion of the inside surface of the outer panel such that the second thermal panel portion is to an outside of a ballistic panel when inserted into the pocket; and wherein the thermal panel is a multi-layer material having a high thermal conductivity.

15. A ballistic carrier having a heat dispersion system, the ballistic carrier comprising:

a carrier in the form of a vest configured to be worn on a torso of a body of a wearer, the carrier having a first body panel forming a front portion of the vest and configured to cover the front torso of the wearer, and a second body panel forming a back portion of the vest and configured to cover the back torso of the wearer, the second body panel attached to the first body panel by shoulder straps;

the first body panel comprising:

an inner panel configured to lie against the body and an outer panel external and opposing the inner panel, the outer panel attached to the inner panel thereby forming a pocket between the inner panel and the outer panel for holding a ballistic panel, the inner panel having an inside surface facing the body and an outside surface facing away from the body, the outer panel having an inside surface facing the body and an outside surface facing away from the body;

a thermal panel attached to the first body panel within the pocket, the thermal panel having a first thermal panel portion attached to, and covering, at least a part of the outside surface of the inner panel and positioned such that it is to an inside of a ballistic panel when inserted into the pocket, the thermal panel bending around proximate an edge of the pocket to a second thermal panel portion, the second thermal panel portion extending along a portion of the inside surface of the outer panel such that the second thermal panel portion is to an outside of a ballistic panel when inserted into the pocket; and wherein the thermal panel is a multi-layer material having a high thermal conductivity;

the second body panel comprising:

an inner panel configured to lie against the body and an outer panel external and opposing the inner panel, the outer panel attached to the inner panel thereby forming a pocket between the inner panel and the outer panel for holding a ballistic panel, the inner panel having an inside surface facing the body and an outside surface facing away from the body, the outer panel having an inside surface facing the body and an outside surface facing away from the body;

a thermal panel attached to the first body panel within the pocket, the thermal panel having a first thermal panel portion attached to, and covering, at least a part of the outside surface of the inner panel and positioned such that it is to an inside of a ballistic panel when inserted into the pocket, the thermal panel bending around proximate an edge of the pocket to a second thermal panel portion, the second thermal panel portion extending along a portion of the inside surface of the outer panel such that the second thermal panel portion is to an outside of a ballistic panel when inserted into the pocket; and wherein the thermal panel is a multi-layer material having a high thermal conductivity.

16. The ballistic carrier of claim 15, wherein the thermal panel of each of the first body panel and the second body panel each comprises a first layer of heat absorbing textile comprising phase change molecules (PCMs), and a second layer applied to, and covering, a first side of the first layer, the second layer comprising a heat transfer film comprising oriented graphite.

17. The ballistic carrier of claim 15, wherein the thermal panel of each of the first body panel and the second body panel each further comprises a backing layer applied to, and covering, a second side of the heat transfer film opposite the first side.

18. The ballistic carrier of claim 15, wherein the first thermal panel portion of each of the first body panel and the second body panel each covers at least 75% or more of the respective outside surface of the inner panel.

19. The ballistic carrier of claim 15, wherein the first thermal panel portion of each of the first body panel and the second body panel each covers at least 55% or more of the respective outside surface of the inner panel.

20. The ballistic carrier of claim 15, wherein the second thermal panel portion of each of the first body panel and the second body panel each extends along at least 25% of a full length of the pocket.

* * * * *